United States Patent [19]

Laake

[11] 4,372,139

[45] Feb. 8, 1983

[54] SELF-CONTAINED RE-KEYABLE LOCK

[76] Inventor: Dennis L. Laake, 619 Willow Hill Ct., Florence, Ky. 41042

[21] Appl. No.: 198,911

[22] Filed: Oct. 20, 1980

[51] Int. Cl.[3] ..... E05B 25/00

[52] U.S. Cl. ..... 70/383

[58] Field of Search ..... 70/382, 383, 384, 385

[56] References Cited

U.S. PATENT DOCUMENTS

| | | | |
|---|---|---|---|
| 2,266,163 | 12/1941 | Ching | 70/382 |
| 2,603,081 | 7/1952 | Pelle | 70/382 |
| 2,970,466 | 2/1961 | Wellekens | 70/382 |
| 3,151,476 | 10/1964 | Wellekens | 70/382 |
| 3,167,944 | 2/1965 | Pickering | 70/382 |
| 4,142,391 | 3/1979 | Paig . | |

OTHER PUBLICATIONS

Literature-Kwikset Division, Emhart Corp., Anaheim, Calif., 1967.

*Primary Examiner*—Robert L. Wolfe

[57] ABSTRACT

A lock in which a replaceable control shaft adjusts a moveable shaft in the main cylinder to different predetermined levels. By adjusting the moveable shaft a new shear line is created between the key pin housed in the shaft and the spring loaded pin tumbler housed in a separate moveable shaft embodied in the lock housing. When a new shear line has been created a new predetermined key will become operable while the prior key, unless it is a master key, becomes inoperable.

A special key when rotated causes a cylinder to rotate creating a cavity in the lock allowing access to the control shaft through the facing of the lock. The control shaft has a spring that compresses upon adjustment securing a nodule on the control shaft into one of several cavity slots. The control shaft has teeth that mesh into the adjustable moveable shaft. The teeth may or may not cause the moveable shaft to change position upon the rotation of the control shaft.

The bridging device connects the main cylinder and the sloped upper portion of the adjustable moveable shaft. This bridge slides under and raises the upper moveable shaft into an aligning position with the adjustable moveable shaft thereby preventing jamming when the main cylinder is returned to its original position.

17 Claims, 11 Drawing Figures

SELF-CONTAINED RE-KEYABLE LOCK

BACKGROUND OF THE INVENTION

1. Field of the Invention

This invention relates generally to key operated locks and more particularly to elements of the lock that enable the re-keying of the lock for use with a new original key while remaining operable for the master key.

2. Description of the Prior Art

As is well known in the art, no simple means previously existed to change a lock whereby the lock can be operated by a new set of keys. Until now it has been necessary to remove the pin tumblers of a lock and to reinsert new and different sized pin tumblers to re-key the lock. U.S. Pat. No. 4,142,391 provides for a re-keying kit for a layman to allow him to re-key a lock. However, to properly make the change, a certain amount of expertise, the proper tools and the proper replaceable parts are necessary. These factors, plus the time involved in making the change, have made frequent re-keying prohibitive and expensive.

Construction keys, as are well known in the art, allow the use of several keys until the construction period is over and a permanent resident makes use of the lock. However, no further re-keying can be made using this method. Frequent re-keying is particularly attractive to persons with rental property and other possessions that are used by numerous other renters.

SUMMARY OF THE INVENTION

The present invention comprises internal elements of a lock that allow the lock to be re-keyed for use by a new original key without a replacement of any parts of the lock.

A special key or master key when turned will cause a rotatable section to turn allowing access to a control shaft through an opening in the face of the lock. The control shaft, which is replaceable, can be set in several predesignated positions which cause predesignated keys to become operable and other keys, except master keys, inoperable. This occurs as the control shaft causes at least one adjustable shaft that houses a key pin to be raised or lowered. A separate upper moveable shaft houses the pin tumblers, aligns with the lower shaft and moves up and down in conjunction with it. Each new position causes a new shear line for the pins.

The adjustable shaft has a bridging device that allows it to align with the upper shaft without jamming. The control shaft is automatically secured into operable positions.

In other conventional locks the main cylinder meshes with the lock housing. In this invention there is a cavity between the pin tumblers selected to have moveable shafts and the lock housing. This allows the upper and lower shafts to align in different shear line positions and still allow the main cylinder to rotate.

This locking mechanism has more parts and precision is needed in its manufacture so it will be more expensive than other locks but a larger cost, the cost to re-key the lock, will be eliminated.

OBJECTS AND ADVANTAGES OF THE INVENTION

The present invention has for an important object to provide a lock that may be easily adjusted to accommodate any prespecified number of new original keys.

It is another object of the invention to provide a mechanism, specifically moveable sections or cylinder shafts, for the changing of the shear line between the main cylinder and the housing of the lock.

It is a further object of the invention to provide a design to prevent the jamming by either the pin tumblers or the spring loaded tumblers housed in the moveable shafts.

It is still another object of the invention to provide a mechanism to prevent unauthorized and unwanted access to the control shaft that adjusts the moveable shafts to desired levels.

It is still a further object of the invention to provide easy access to the elongated core element or control shaft to the owner of the special master key.

It is still a further object of the invention to provide a mechanism that will operate the lock with a master key but will only allow access to the control shaft with the special master key.

It is still a further object of the invention to provide a control shaft, that has a desired number of settings corresponding to new keys, that may be replaced to allow additional re-keying of the lock.

It is still a further object of the invention to provide a mechanism such that the control shaft can only be set in an operable designated position.

It is still a further object of the invention to provide a mechanism that is inexpensive to produce and subsequently inexpensive to own and operate.

Further objects and advantages of my invention will become apparent from a consideration of the drawings and ensuing description thereof.

BRIEF DESCRIPTION OF THE DRAWINGS

Referring more particularly to the accompanying drawings, which are for illustrative purposes only.

DESCRIPTION OF THE PREFERRED EMBODIMENT

Figure 1:
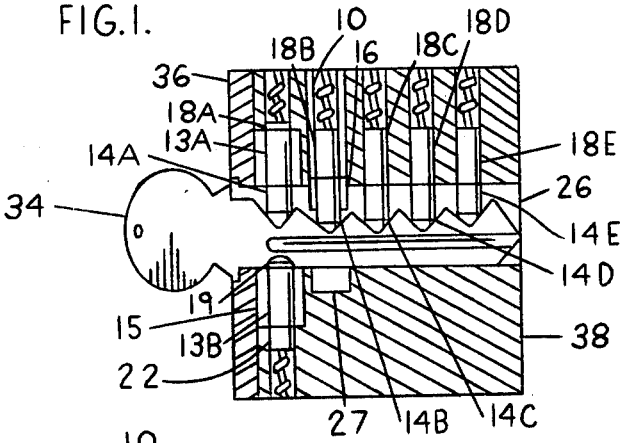
FIG. 1 is a cross-sectional side view detailing internal parts including: the adjustable moveable section (shaft), the moveable upper section (shaft) and the entry release mechanism to the control shaft.

In the drawings, like reference characters, indicate like elements throughout.

The invention has been illustrated as being applied to a pin tumbler type lock. A variety of these locks are known in the art and therefore this invention details the principle mechanisms adaptable to accomodate the various lock designs.

Description of Moveable Sections and Control Shaft and the Operation Thereof FIG. 1 illustrates the spring driven tumblers 18A, 18B, 18C, 18D, 18E that create a shear line with the key pins 14A, 14B, 14C, 14D, 14E housed in the main cylinder 26 when an operable key 34 or master key is inserted. A moveable section 16, hereafter referred to as an adjustable shaft 16, houses the main cylinder key pins 14A–E. A separate moveable section 10, hereafter referred to as a moveable shaft 10, houses the spring driven tumbler 18B. The adjustable shaft and moveable shaft are collectively referred to as shafts. Any one or any number of the pin tumbler positions may be outfitted with an adjustable shaft 16 and a movable shaft 10. The adjustable shaft 16 may be set into several positions which create a new shear line. The upper moveable shaft 10 moves up and down to accommodate the position of the adjustable shaft 16.

Figure 2:
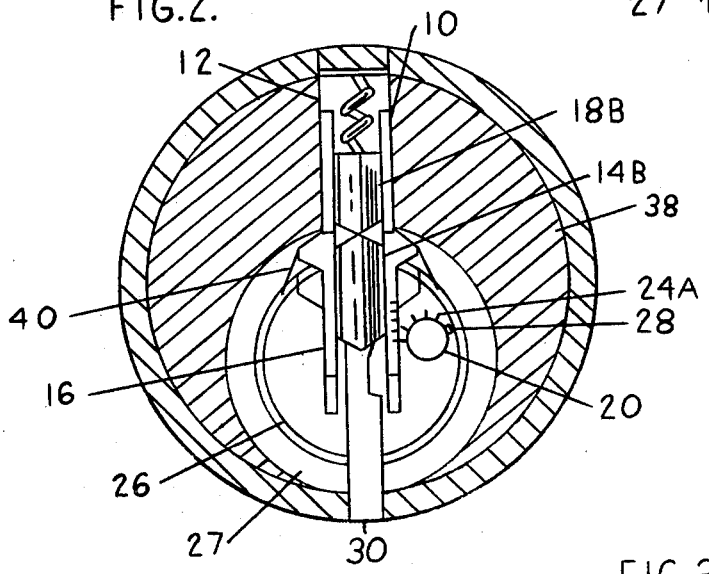
FIG. 2 is a cross-sectional frontal view detailing internal parts including: the control shaft with teeth that mesh into the adjustable shaft, the bridge between the adjustable shaft and the graduated portion of the adjustable shaft.
Figure 4:
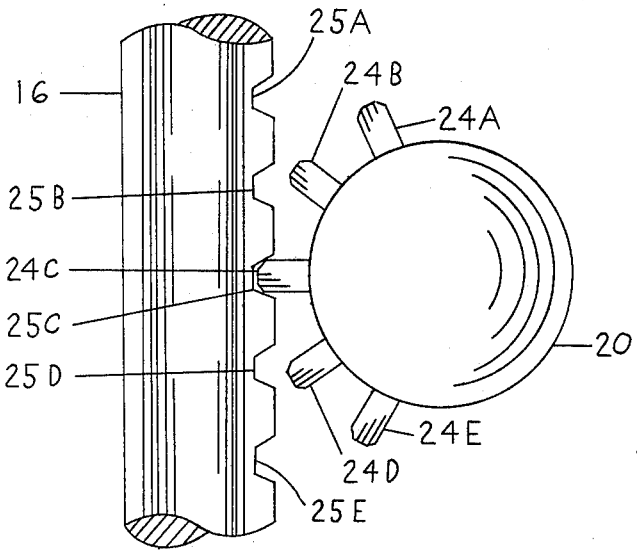
FIG. 4 is a cross-sectional frontal view of the lower section of the adjustable shaft, the control shaft and the teeth on the periphery of the control shaft.
Figure 6:
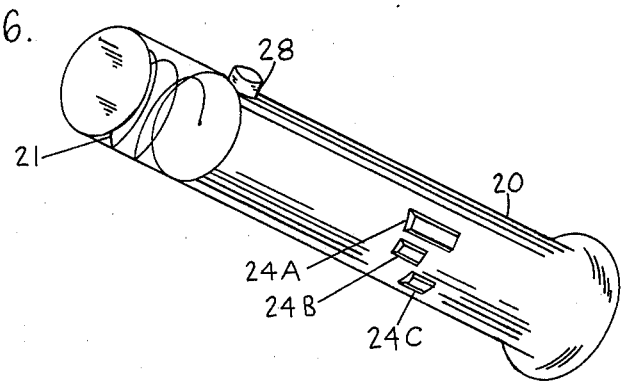
FIG. 6 is an oblique view of the control shaft including the spring device at the shaft's end, the nodule and teeth on the shaft.

The adjustable shaft 16 is controlled by an elongated core element 20, hereafter referred to as the control shaft 20 as illustrated in FIG. 2, FIG. 4 and FIG. 6.

The control shaft 20 is outfitted with any specified number of teeth 24A–E that mesh into the adjustable shaft 16. The teeth 24A–E raise or lower the adjustable shaft 16 to specified heights, corresponding to cuts in the key, as the control shaft 20 is rotated.

After the new shear line has been created, a new predesignated key will operate the lock while the previous key, unless it was a master key designed to operate in this new position, will be inoperable.

In its lowest position the adjustable shaft 16 will create a horizontal shear line from the first pin position 18A to the plug end of the main cylinder 26. This allows the main cylinder 26 to be inserted or removed freely into the housing of the lock 38.

A cavity 27 in the housing of the lock, hereafter referred to as a cutout area, is wide enough to allow the adjustable shaft 16 in a raised position to be turned. The cutout area 27 is not so wide as to encroach into the adjoining pin tumbler position unless it is also outfitted with an adjustable shaft 16.

Description of Bridge/Operation of Bridge

Figure 3:
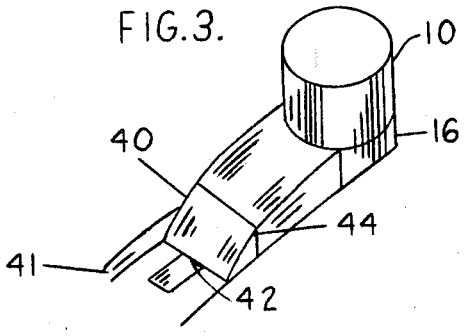
FIG. 3 is an oblique view of the bridge device connecting the adjustable shaft to the main cylinder.

The upper portion of the adjustable shaft 16 in this design, as illustrated in FIG. 2 and FIG. 3, is wider than the upper moveable shaft 10 and its top slopes downward. A part, hereafter referred to as a bridge 40, connects the adjustable shaft 16 at a hinge 44 to the main cylinder 26 via an adjutment 42 to the bridge 40 that is fitted in a groove 43 in the main cylinder 26. As the adjustable shaft 16 is moved upwards or downwards, the adjutment 42 slides in the groove 43 and the bridge 40 swivels at the hinge 44. As the key turns the main cylinder 26, the upper moveable shaft 16 is free to move downward into the cutout area 27 previously occupied by the adjustable shaft. The upper moveable shaft 16 is weighted to facilitate its automatic downward movement. As the adjustable shaft 16 is returned the upper moveable shaft 10 is properly positioned as it slides up the brigde 40 and over the sloped portion of the adjustable shaft. The main cylinder 26 is recessed 41 in the area of the bridge 40 and the adjustable shaft 16. When the adjustable shaft 16 is in its lowest position, it and the bridge 40 lie tangent to or below the periphery of the main cylinder 26. This allows the main cylinder to be removed readily with no obstructions.

The control shaft 20 is embodied within the main cylinder 26, FIG. 2, so as not to interfere with the bridge 40 and to allow easy removal.

Description of Teeth and Grooves and Operation thereof

Figure 5:
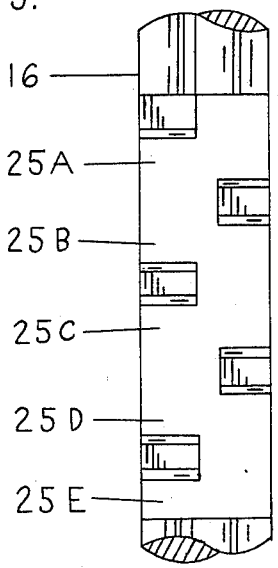
FIG. 5 is a side view of lower section of the adjustable shaft featuring grooved areas in which the teeth of the control shaft mesh.

FIG. 5 illustrates the side of the adjustable shaft 16 that meshes with the teeth 24A–E of the control shaft 20. The adjustable shaft is cutaway such that there are grooves in which the teeth fit. Within this grooved section are tapered walls 25A–E which the teeth abut against. The walls 25A–E should not be greater in size than the radius of the adjustable shaft 16. Nor should a wall's length extend directly above any portion of the wall in the next lower position. The teeth of the control shaft 20 may be full length 24A, slightly smaller than the diameter but larger than the radius of the adjustable shaft 16 or the teeth may be half the size 24B, 24C, as shown in FIG. 6. A full length tooth will cause the adjustable shaft to be moved when it is in the grooved section. A half sized tooth will only move the adjustable shaft if it abuts against a wall. When the control shaft is turned a half sized tooth is placed in the grooved section with a walled section horizontally adjacent to it, there will be no support of the adjustable shaft and it will move downward, to its prior position, until the tooth abuts against a walled section. The control shaft would be functional without teeth in all positions. This design allows the control shaft to be turned without a corresponding move of the adjustable shaft. The sizes detailed may be changed without affecting the functioning of this apparatus.

Description of Housing for Control Shaft/Operation of Control Shaft

Figure 7:
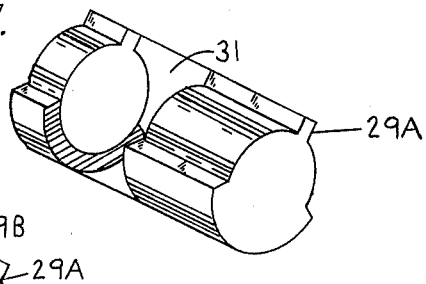
FIG. 7 is an oblique view of the housing for the front of the control shaft with a view of the open space for the teeth on the control shaft.
Figure 8:
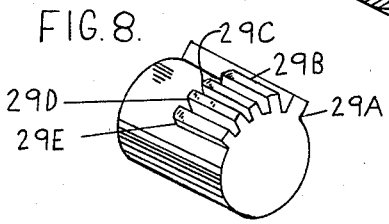
FIG. 8 is an oblique view of the housing for the end of the control shaft with alternate slots that can house the nodule on the control shaft.
Figure 9:
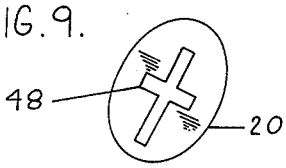
FIG. 9 is an oblique view of the front of control shaft.

FIG. 7 and FIG. 8 illustrate the section of the lock housing 38 that houses the control shaft 20. A nodule 28, FIG. 2 and FIG. 6 located on the control shaft 20, fits into the cavity slot 29A of the housing. The teeth fit through a passage into a cavity 31 in the lock housing. This cavity 31 allows the teeth to move unhindered when the control shaft 20 is turned. In the normal position, the nodule 28 remains in the cavity slot 29A of the housing. To turn the control shaft 20 it is necessary to depress the face of the control shaft FIG. 9. At this instance the spring 21 housed in the end of the control shaft 20 contracts, FIG. 6, and the nodule 28 departs the cavity slot 29A–E in the housing. The control setting 48 is turned to a new position, thereby turning the control shaft 20 and the nodule 28 to new positions. When the control shaft 20 is released the spring 21 will automatically expand. The nodule 28 returns into a different cavity slot 29A–E corresponding to the new control setting position. The control shaft is secured in this position unless the face of the shaft is depressed as before. The end of the nodule 28 is rounded as are the sections of the housing between the cavity slots 29A–E. This facilitates the nodule's return to a cavity slot 29A–E and prevents the nodule 28 from becoming blocked.

Description of Entry to Control Shaft and Operation thereof

Figure 10:
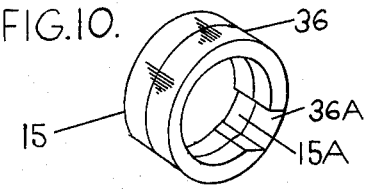
FIG. 10 is an oblique view of a section of the housing in the front part of the lock and a cylinder that both encircle the main cylinder (not shown) featuring cut-out sections in each that align to form a cavity.
Figure 11:
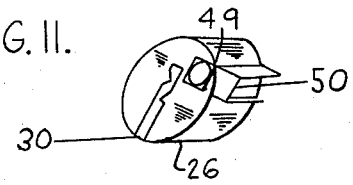
FIG. 11 is an oblique view of the main cylinder in a turned position featuring an opening to the face of the control shaft and a part that can be moved into a cavity in the lock.

FIG. 1, FIG. 10, and FIG. 11 illustrate an entry release device that prevents unauthorized access to the control shaft 20.

The housing 36 on the front part of the lock is a solid metal piece which encircles the main cylinder 26. Inside this outer housing 36 a reinforced piece of the housing encircles the main cylinder 26. There is a cavity section 36A in the housing, hereafter referred to as a cutout area 36A. Behind this piece of housing 36 in an outer cylinder 15 that also encircles the main cylinder 26. It extends to engulf at least one pin position 18A and as many pin positions as deemed necessary. The outer cylinder 15 has a cavity 15A, hereafter referred to as a cutout area 15A, which is cut into the lock but not as deep as the first pin position.

While the main cylinder 26 will turn with a regular key or master key, the outer cylinder 15 will only turn when a special key or master key causes a shear line between the lock housing 38 and the pins 13A, 13B in the outer cylinder 15 to be formed. The regular key causes the key pins 14A and 19 to form a shear line with the outer cylinder 15 while the pins 13A and 13B do not form a shear line with the lock housing thus not allowing the outer cylinder to turn. The special key or master key will operate the lock but it will also allow the outer cylinder 15 to be turned to a position where the cutouts 15A and 36A align. While in this position the facing 40 in front of the control shaft 20 can be moved. A part 50 consisting of a front piece, a top and a bottom piece, which is connected to the facing 49 will slide into the cavity created by the alignment of the cutouts 15A and 36A. The control lever 48 on the control shaft 20 is now exposed allowing adjustment of the position or the removal of the control shaft 20 from the lock housing.

Description of Other Embodiments

While the above description contains many specificities, these should not be construed as limitations on the scope of the invention, but rather as an exemplification of one preferred embodiment thereof. Many other variations are possible, for example:

(1) the adjustable shaft and corresponding control shaft may be located in the housing of the lock and not in the main cylinder;

(2) the connection between the adjustable shaft and the control shaft may be any of a series of gears and teeth or other appropriate means which could negate size limitations of the parts;

(3) the position of the control shaft may be set at any angle to the adjustable shaft;

(4) access to the control shaft may be set in the side or back of lock instead of the face;

(5) the shape of the adjustable shaft and the shape of the cavity in which the moveable shafts align may be contoured to insure no jamming of internal parts;

(6) spring or compression type devices could be used such that the moveable shafts and the control shaft are placed into proper positions as previously described;

(7) the size of the walls and the grooves in the adjustable shaft can be changed without altering the functionality of the mechanism;

(8) access to the control shaft could be controlled by a master key that activates a lever which when moved creates an opening in the face of the lock;

(9) other readily apparent changes in design without changes in functionality.

Additionally the elements and design of the lock for use of a master key are well known in the art and are not detailed in this embodiment. However, the implimentation of a master key design in conjuction with this embodiment is not restricted and adds an important option of design to the locking mechanism.

Accordingly, the scope of the invention should be determined not by the embodiment illustrated, but by the appended claims and their legal equivalents.

What I claim is:

1. A pin tumbler locking mechanism comprising at least one key pin housed in the main cylinder that aligns with at least one pin tumbler located in the housing for said main cylinder wherein the improvement comprises a means to adjust the shear line, at the location of said key pin and said pin tumbler and between said main cylinder and said housing for said main cylinder, and a means to rotate said main cylinder after said means to adjust the shear line has been engaged.

2. The locking mechanism of claim 1 having a means to expose said elongated core element means for adjustment thereof by use of a special key or master key while preventing access to said elongated core element means with other operational keys.

3. A rekeyable pin tumbler locking mechanism not requiring the removal of internal parts for the rekeying comprising a main cylinder with at least one adjustable shaft, at least one moveable shaft outside of the main cylinder, the said adjustable shaft and said moveable shaft align and house a key pin and pin tumbler respectively, an elongated core element means to adjust the position of either said adjustable shaft or said moveable shaft whereby a new shear line is created between said adjustable shaft and said moveable shaft adjustment, and a cavity means whereby said adjustable shaft and said moveable shaft in any set position rotate without hindrance when the operational key is turned.

4. The self-contained housing of at least one key pin and of at least one pin tumbler of a lock that aligns with said key pin comprising moveable sections means that create a shear line at the position where said key pin and said pin tumbler are encased by said moveable sections means and means allowing rotation of main cylinder when said moveable sections are engaged in different shear line positions, the said housing being adjustable by means of a replaceable elongated core element means.

5. The locking mechanism of claim 1 having a rotatable section means encasing at least one pin position of said main cylinder, the said rotatable section means having at least one pin aligning with at least one key pin of said main cylinder, and a pin tumbler in the lock housing that aligns with said pin in said rotatable section means such that a special key causes said pin and said pin tumbler to form a shear line between said rotatable section means and said lock housing allowing said rotatable section means to rotate as the said main cylinder is rotated whereby other keys that operate the lock do not cause rotation of said rotatable section means when said keys are engaged.

6. The locking mechanism of claim 5 wherein said rotatable section means has a cavity means that aligns with a cavity means in a section of the lock housing, the rotation of said special key turns said rotatable section into said position which allows a moveable part housed in said main cylinder with an exposed connected part protruding through an opening in the face of said main cylinder to move laterally into said cavity means exposing the face of said elongated core element means to enable adjustment thereof.

7. The locking mechanism of claim 1 having an elongated core element means to adjust the position of at least one of either a moveable shaft or adjustable shaft that house a pin tumbler and a key pin respectively, wherein said elongated core element means with teeth means of similar or different configuration than of former said elongated core element means wherein said teeth means mesh with at least one of either said moveable shaft or said adjustable shaft.

8. The locking mechanism of claim 1 having an elongated core element means to adjust the position of at least one of either a moveable shaft or adjustable shaft that house a pin tumbler and a key pin respectively, said elongated core element means with a retractable section means having an outer part fitting into a cavity slot in said main cylinder, at least one other cavity slot extending parellel to former said cavity slot and means for said outer part to leave said former cavity slot and enter latter said cavity slot as said elongated core element means is placed into retractable position and rotated whereby said elongated core element means automatically returns to expanded position when released.

9. The locking mechanism of claim 1 having a part connected to at least one of either a moveable shaft or adjustable shaft that house a pin tumbler and a key pin respectively, wherein said part adjusts to form an angle such that the other said shaft slides along the edge of said part until said shafts align when said main cylinder is returned to its original position after having been rotated thereby preventing the jamming of said shafts.

10. The locking mechanism of claim 1 having an elongated core element means to adjust the position of at least one of either a moveable shaft or adjustable shaft that house a pin tumbler and a key pin respectively, having at least two vertically positioned teeth means on said elongated core element means, said top tooth means fitting into grooved section means of at least one of said shafts, said grooved section means having a width greater than said top tooth means width and a width greater than twice the width of said lower tooth means, said lower tooth means width not crossing the midpoint of said grooved section means, said grooved section means containing at least two walled sections on alternate sides of said grooved section means and vertically spaced such that said top tooth means abuts against said top walled section wherein the rotation of said elongated core element means causes said top tooth means to leave said grooved section means and causes said other tooth means to enter said grooved section means, the said shaft returns to its prior position where said other tooth means abuts against said top walled section.

11. The locking mechanism of claim 1 having an elongated core element means to adjust the position of at least one of either a moveable shaft or adjustable shaft that house a pin tumbler and a key pin respectively, having a means to automatically secure said elongated core element means into an operational position whereby said shafts create a shear line such that a predesignated key will operate the lock.

12. The locking mechanism of claim 1 having at least one of either a moveable shaft or an adjustable shaft that house a pin tumbler and a key pin respectively, having a means to prevent said shafts from jamming or colliding together when said main cylinder is rotated to or away from an aligning position of said shafts.

13. The locking mechanism of claim 1 having an elongated core element means to adjust the position of at least one of either a moveable shaft or adjustable shaft that house a pin tumbler and a key pin respectively, having a means to change the positional setting of said elongated core element means without a corresponding change in the position of said shafts.

14. The locking mechanism of claim 1 having at least one of either a moveable shaft or adjustable shaft that house a pin tumbler and a key pin respectively, having a means to position said shafts wherein the other said shaft automatically aligns with the former said shaft creating a shear line for said key pins and pin tumblers housed in respective said shafts.

15. The locking mechanism of claim 1 having at least one of either a moveable shaft or adjustable shaft that house a pin tumbler and a key pin respectively, having a means to position said shafts such that no interference from said shafts occurs with other internal parts of said locking mechanism when said main cylinder is removed from the lock housing or when said locking mechanism is operated.

16. The self-contained housing of at least one key pin and of at least one pin tumbler of a lock that aligns with said key pin comprising moveable sections means that create a shear line at the position where said key pin and said pin tumbler are encased by said moveable sections means and means allowing rotation of main cylinder when said moveable sections are engaged in different shear line positions, the said housing being adjustable by means of a replaceable elongated core element means means, a means to allow access to said elongated core element means by use of a special key or master key, a means to prevent the jamming of said housing with other internal parts of the locking mechanism, a means to adjust said elongated core element means without a corresponding adjustment of said housing, and a means to have the housing be properly positioned in a operable position after adjustment of said elongated core element means.

17. The locking mechanism of claim 1 having more than one set of said adjustable shafts and said moveable shafts that house said pin tumblers and said key pins respectively that mesh with at least two sets of teeth means located on the periphery of said elongated core element means.

* * * * *